US008499738B2

(12) United States Patent
Storch et al.

(10) Patent No.: US 8,499,738 B2
(45) Date of Patent: Aug. 6, 2013

(54) CONTROL SYSTEMS FOR A VARIABLE CAPACITY ENGINE OIL PUMP

(75) Inventors: Kevin J. Storch, Brighton, MI (US); David R. Staley, Flushing, MI (US); Bryan K. Pryor, Farmington, MI (US); Vijay Ramappan, Novi, MI (US); Morena Bruno, Chivasso (IT); Roberto Argolini, Milan (IT)

(73) Assignee: GM Global Technology Operations LLC

( * ) Notice: Subject to any disclaimer, the term of this patent is extended or adjusted under 35 U.S.C. 154(b) by 465 days.

(21) Appl. No.: 12/825,772

(22) Filed: Jun. 29, 2010

(65) Prior Publication Data

US 2011/0209682 A1 Sep. 1, 2011

Related U.S. Application Data

(60) Provisional application No. 61/309,126, filed on Mar. 1, 2010.

(51) Int. Cl.
*F01M 1/02* (2006.01)

(52) U.S. Cl.
USPC ..... 123/196 R; 184/6.5

(58) Field of Classification Search
USPC ..... 123/196 R, 196 CP, 196 S; 184/6.5
See application file for complete search history.

(56) References Cited

U.S. PATENT DOCUMENTS

| | | | | |
|---|---|---|---|---|
| 5,339,776 | A * | 8/1994 | Regueiro | 123/196 AB |
| 6,904,937 | B2 | 6/2005 | Fischer | 137/625.64 |
| 2002/0083915 | A1 * | 7/2002 | Choi | 123/196 AB |
| 2006/0088431 | A1 * | 4/2006 | Berger | 418/19 |
| 2008/0240941 | A1 | 10/2008 | Kumazaki et al. | 417/53 |

FOREIGN PATENT DOCUMENTS

| | | | |
|---|---|---|---|
| JP | 04017708 A | * | 1/1992 |
| WO | WO 2006/066405 | | 6/2006 |

* cited by examiner

*Primary Examiner* — Noah Kamen

(57) ABSTRACT

An oil circulating control system for an engine includes an engine speed module and a mode selection module. The engine speed module determines a speed of the engine. The mode selection module is configured to select a first pressure mode and a second pressure mode of an oil pump of the engine for the speed. The selection module selects one of the first pressure mode and the second pressure mode based on at least one mode request signal. The mode selection module signals a solenoid valve of a variable oil pressure circuit of the oil pump to transition to a first position when operating in the first pressure mode and to a second position when operating in the second pressure mode.

20 Claims, 6 Drawing Sheets

CONTROL SYSTEMS FOR A VARIABLE CAPACITY ENGINE OIL PUMP

CROSS-REFERENCE TO RELATED APPLICATIONS

This application claims the benefit of U.S. Provisional Application No. 61/309,126, filed on Mar. 1, 2010. The disclosure of the above application is incorporated herein by reference in its entirety.

FIELD

The present invention relates to oil circulating systems for an internal combustion engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine (ICE) typically includes an oil circulating system. The oil circulating system includes an oil pump that is mechanically connected to a crankshaft of the ICE. This connection assures that the oil pump is circulating oil to and from components of the ICE when the crankshaft is rotating (i.e. engine is operating). Output pressure of the oil pump is directly related to the rotating speed of the crankshaft. As the speed of the crankshaft increases the output pressure of the oil pump increases. This provides increased cooling of the ICE at increased engine speeds.

An engine oil pump introduces drag on an ICE due at least to the mechanical connection on the crankshaft of the ICE. The drag on the crankshaft increases with increased engine speed. Increased drag negatively affects available output torque and fuel economy of the ICE.

An engine oil pump is designed to provide a required flow (i.e. the amount of fluid that flows in a predetermined period) and pressure to adequately lubricate and cool an ICE. The flow and pressure capabilities of the engine oil pump are based on worst case operating conditions. An example worst case operating condition is when engine oil is hot (e.g., 180-300° F.) and the ICE is operating at low engine speed (e.g., less than 3000 revolutions-per-minute (rpm)).

For this reason, the engine oil pump provides oil flows and pressures that exceed required oil flows and pressures for certain operating states of the ICE. As a non-worst case operating state example, an ICE may have a cool oil temperature (e.g., less than 180° F.) and be operating at a low engine speed. In this operating state, the engine oil pump may provide flow and pressure for the worst case operating condition, which is greater than that required. As a result, unjustified drag on the crankshaft occurs during non-worst case operating states. This decreases available output torque and fuel economy of the ICE.

SUMMARY

An oil circulating control system for an engine is provided and includes an engine speed module and a mode selection module. The engine speed module determines a speed of the engine. The mode selection module is configured to select a first pressure mode and a second pressure mode of an oil pump of the engine for the speed. The selection module selects one of the first pressure mode and the second pressure mode based on at least one mode request signal. The mode selection module signals a solenoid valve of a variable oil pressure circuit of the oil pump to transition to a first position when operating in the first pressure mode and to a second position when operating in the second pressure mode.

In other features, a method of operating an oil circulating control system of an engine is provided. The method includes determining a speed of the engine. A first mode request signal is received. A first pressure mode of an oil pump of the engine is selected for the speed when the first mode request signal is in a first state. A second pressure mode of the oil pump is selected for the speed when the mode request signal is in a second state. A solenoid valve of a variable oil pressure circuit of the oil pump are signaled to transition to a first position when operating in the first pressure mode and to a second position when operating in the second pressure mode.

In still other features, the systems and methods described above are implemented by a computer program executed by one or more processors. The computer program can reside on a tangible computer readable medium such as but not limited to memory, nonvolatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
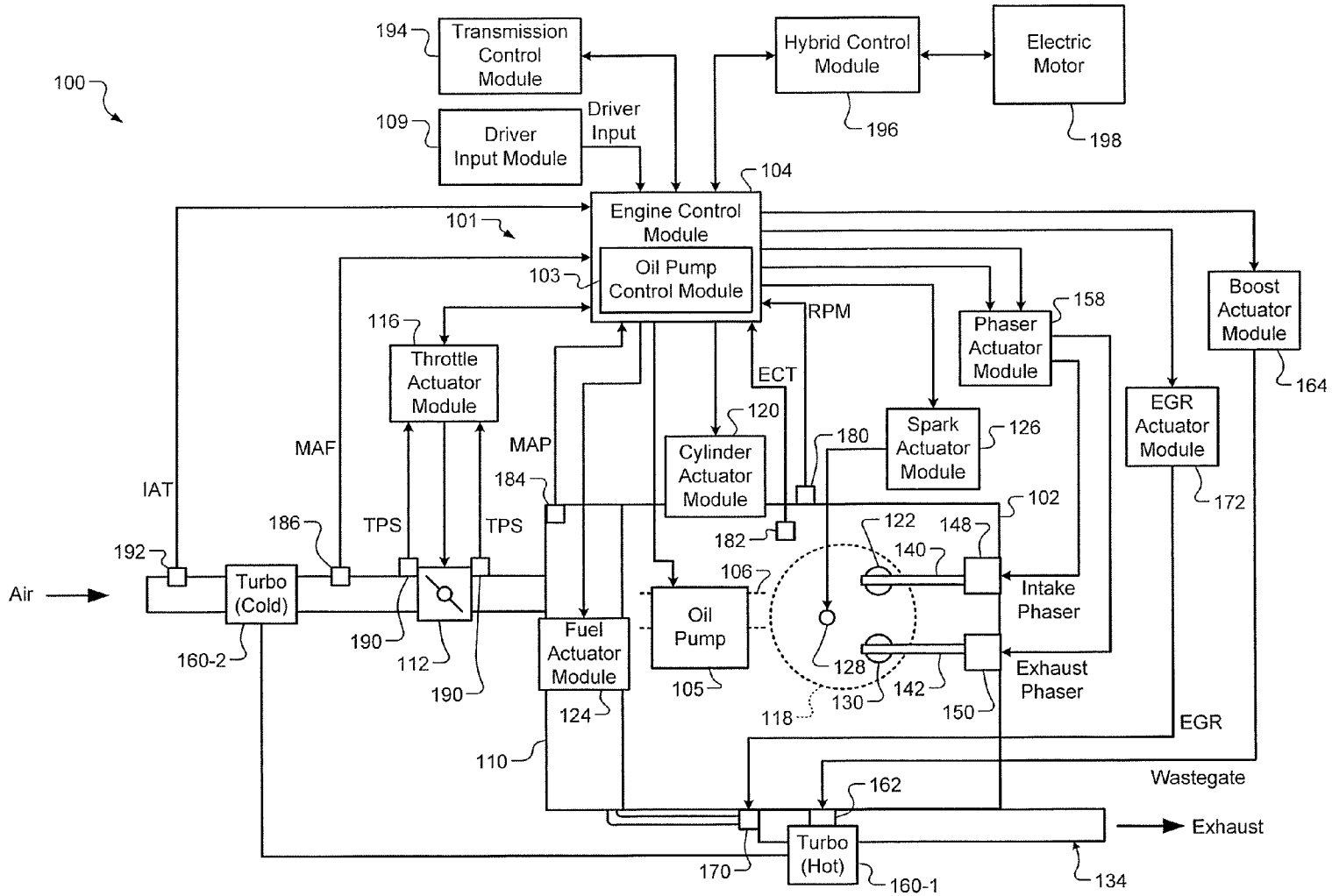
FIG. 1 is a functional block diagram of an engine control system incorporating an oil circulating control system in accordance with the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Traditionally, an oil pump of an engine is designed for a worst case operating condition. As a result, the oil pump provides a minimum flow and pressure that is required for the worst case operating condition. During all other operating conditions, the pump may provide an excess of flow and pressure. This negatively affects the available torque output and the fuel economy of the engine.

Control systems are disclosed herein for a variable displacement (switchable) oil pump of an engine. Active control of a variable displacement pump allows for selection of different flows and pressures (e.g., high and low pressures) for the same engine speed. This increases fuel economy and available engine output torque while meeting and/or exceeding lubrication requirements of an engine.

Figure 2:
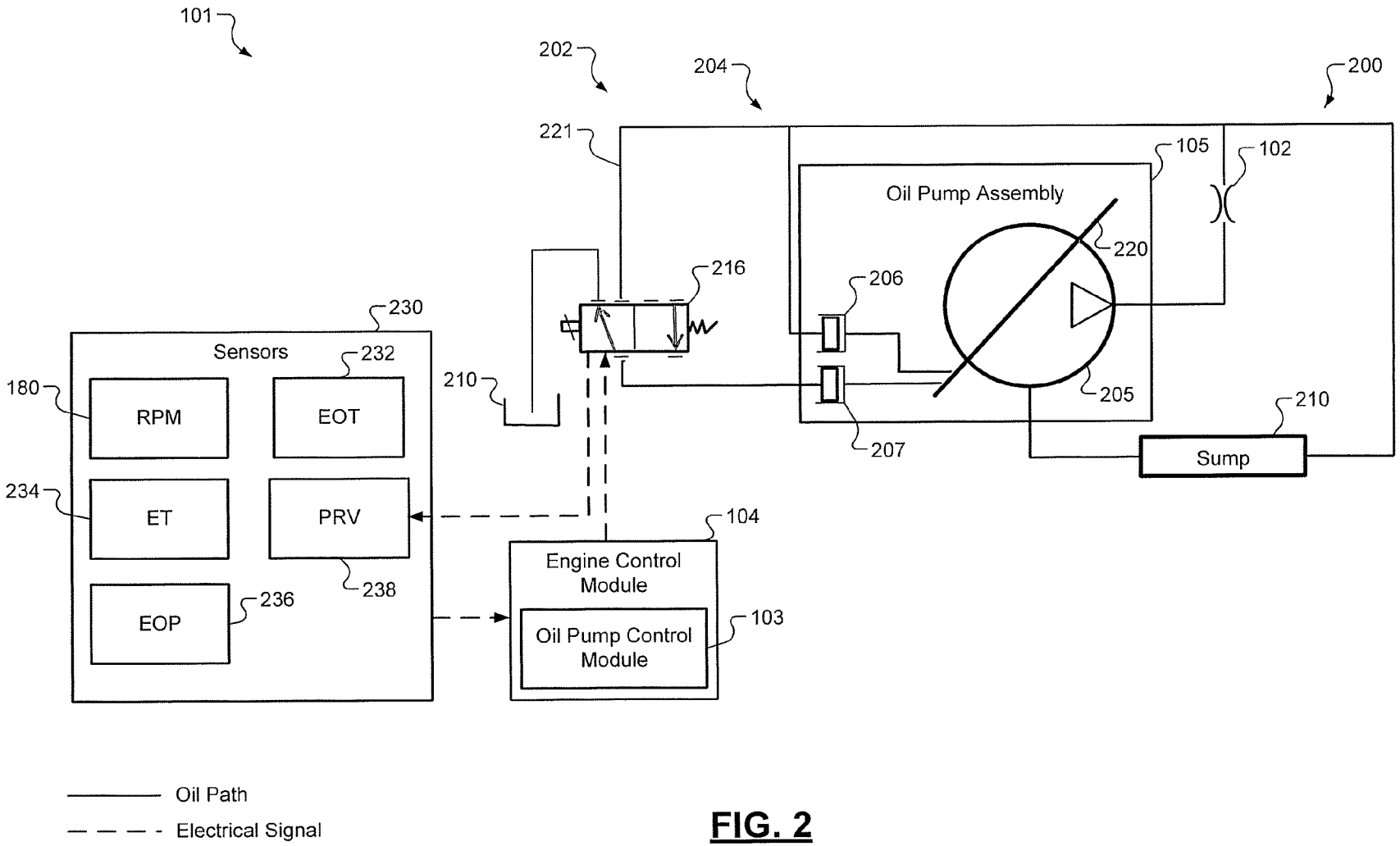
FIG. 2 is a functional block diagram of the oil circulating control system in accordance with the present disclosure.

In FIG. 1, a functional block diagram of an exemplary engine control system 100 is shown. The engine control system 100 includes an oil circulating control system 101 that controls circulation of oil to and from components of an engine 102. The oil circulating control system 101 includes an oil pump control module 103, which may be included as part of an engine control module (ECM) 104. The oil pump control module 103 controls operation of a multiple and/or variable displacement oil pump. The oil pump assembly 105 draws oil from a sump (e.g., oil pan) and directs oil to components (e.g., valves, cylinders, camshafts, etc.) of the engine 102. An example sump is shown in FIG. 2.

The oil pump assembly 105 is mechanically connected to a crankshaft 106 of the engine 102. The oil pump assembly 105 may be a vane pump and/or gear pump. Oil flow and pressure output of the oil pump assembly 105 is directly related to the rotating speed of the crankshaft 106 and is based on a control signal generated by the oil pump control module 103. The oil pump assembly 105 may be located in a sump (e.g., oil pan) or elsewhere on the engine 102.

Figure 5:
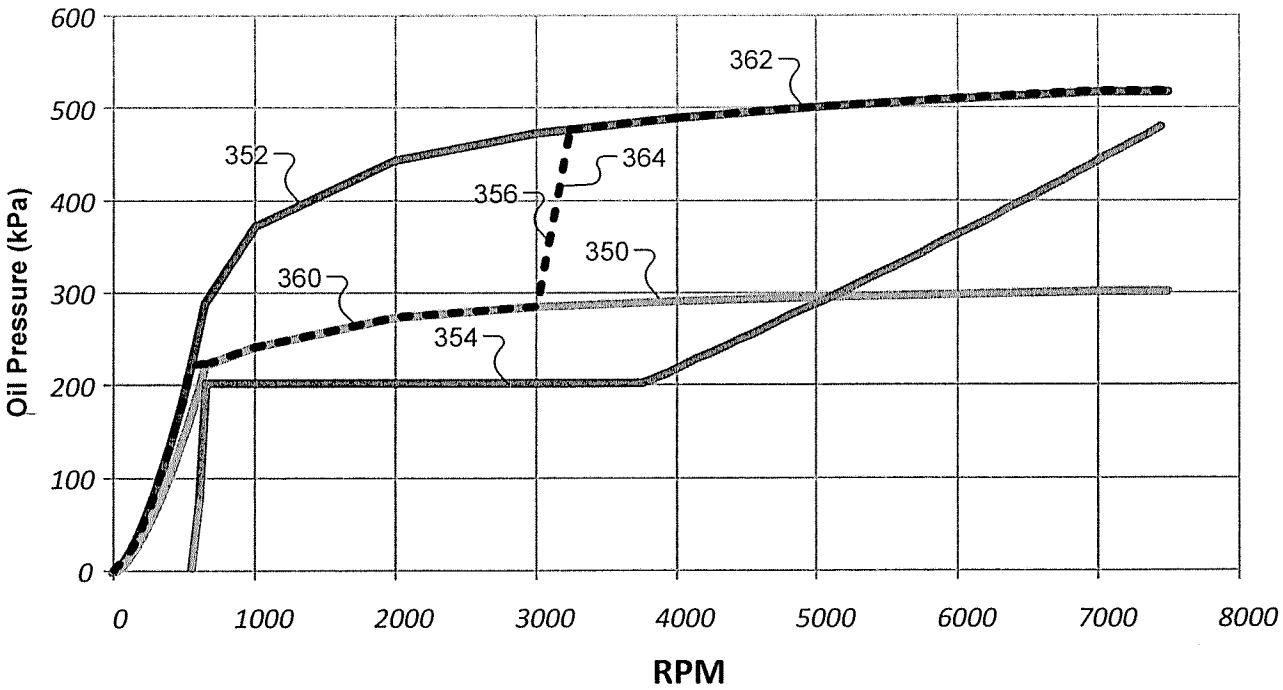
FIG. 5 is an exemplary plot of a pressure mode transition based on engine speed in accordance with the present disclosure.
Figure 6:
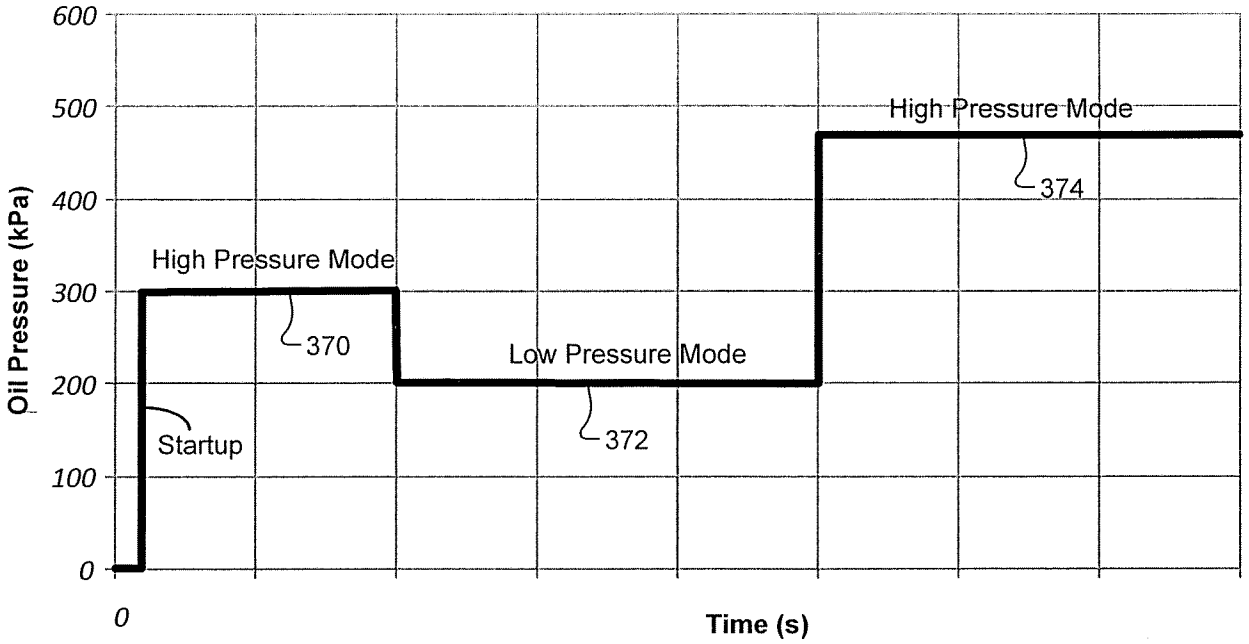
FIG. 6 is an exemplary plot of pressure mode transitions in accordance with the present disclosure.

The oil pump assembly 105 may have multiple pressure modes for a given engine speed. The pressure modes are selected via the oil pump control module 103. As a first example, the oil pump assembly 105 may have a first pressure mode and a second pressure mode. The first pressure mode may be a high-pressure (e.g., 300-550 kilo-Pascals (kPa)) mode and the second pressure mode may be a low-pressure (e.g., 200-300 kPa) mode. Example high and low pressure mode operating curves are shown in FIG. 5. Example transitions between operating modes are shown in FIG. 6. The first pressure mode may be associated with engine speeds of greater than a first predetermined threshold or engine speed. The second pressure mode may be associated with engine speeds less than or equal to the first predetermined engine speed. The oil pump may have any number of pressure modes for any engine speed.

The engine 102 that combusts an air/fuel mixture to produce drive torque for a vehicle based on driver input from a driver input module 109. Air is drawn into an intake manifold 110 through a throttle valve 112. For example only, the throttle valve 112 may include a butterfly valve having a rotatable blade. The ECM 104 controls a throttle actuator module 116, which regulates opening of the throttle valve 112 to control the amount of air drawn into the intake manifold 110.

Air from the intake manifold 110 is drawn into cylinders of the engine 102. While the engine 102 may include any number of cylinders, for illustration purposes a single representative cylinder 118 is shown. The ECM 104 may instruct a cylinder actuator module 120 to selectively deactivate some of the cylinders under certain engine operating conditions.

The engine 102 may operate using a four-stroke cycle. The four strokes, described below, are named the intake stroke, the compression stroke, the combustion stroke, and the exhaust stroke. During each revolution of the crankshaft 106, two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 104 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 104, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

During the combustion stroke, the combustion of the air/fuel mixture drives the piston down, thereby driving the crankshaft 106. The combustion stroke may be defined as the time between the piston reaching TDC and the time at which the piston returns to bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140. The exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 104.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, which compresses air leading into the throttle valve 112. In various implementations, a supercharger (not shown), driven by the crankshaft 106, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 104 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Sensors

The engine system 100 includes various sensors. The engine system 100 may include an engine speed sensor 180 that is used to detect speed of the crankshaft 106 in revolutions-per-minute (rpm). The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 104 may use signals from the sensors to make control decisions for the engine system 100. Additional sensors are disclosed and described with respect to FIGS. 2-4.

The ECM 104 may communicate with a transmission control module 194 to coordinate shifting gears in a transmission (not shown). For example, the ECM 104 may reduce engine torque during a gear shift. The ECM 104 may communicate with a hybrid control module 196 to coordinate operation of the engine 102 and an electric motor 198.

The electric motor 198 may also function as a generator, and may be used to produce electrical energy for use by vehicle electrical systems and/or for storage in a battery. In various implementations, various functions of the ECM 104, the transmission control module 194, and the hybrid control module 196 may be integrated into one or more modules.

Each system that varies an engine parameter may be referred to as an actuator that receives an actuator value. For example, the throttle actuator module 116 may be referred to as an actuator and the throttle opening area may be referred to as the actuator value. In the example of FIG. 1, the throttle actuator module 116 achieves the throttle opening area by adjusting an angle of the blade of the throttle valve 112.

Similarly, the spark actuator module 126 may be referred to as an actuator, while the corresponding actuator value may be the amount of spark advance relative to cylinder TDC. Other actuators may include the cylinder actuator module 120, the fuel actuator module 124, the phaser actuator module 158, the boost actuator module 164, and the EGR actuator module 172. For these actuators, the actuator values may correspond to number of activated cylinders, fueling rate, intake and exhaust cam phaser angles, boost pressure, and EGR valve opening area, respectively. The ECM 104 may control actuator values in order to cause the engine 102 to generate a desired engine output torque.

Referring now also to FIG. 2, the oil circulating control system 101 is shown. Solid lines between devices refer to oil lines or paths. Dashed lines between devices refer to electrical signal lines. The oil circulating control system 101 includes an engine lubrication circuit 200, a variable oil pressure control circuit 202, and a pressure regulating circuit 204. Each of the circuits 200-206 includes the oil pump control module 103, the ECM 104, the oil pump assembly 105 and a sump (e.g., oil pan) 210. The oil pump assembly includes a variable displacement oil pump ("oil pump") 205, a primary chamber 206, and a secondary chamber 207.

The engine lubrication circuit 200 provides oil to and the engine 102. In operation, engine oil in the sump 210 is drawn to the oil pump assembly 105, where it is pressurized, and directed to the engine 102. The engine oil is directed from the engine 102 back to the sump 210.

The variable oil pressure control circuit 202 is used to provide two or more possible oil pressures to the engine 102 for each speed of the engine 102. The variable oil pressure control circuit 202 includes a solenoid valve 216. The oil pump control module 103 may signal the solenoid valve 216 via a relay (not shown). The solenoid valve 216 has multiple positions, which are selectable based on a control signal from the oil pump control module 103. The solenoid valve 216 may have any number of valve positions and may be connected between the engine 102 and the oil pump assembly 105 or anywhere within the lubrication circuit 200. An oil pressure signal is provided via the lubrication circuit 200 either upstream or downstream of an oil filter (not shown) to control displacement of the oil pump 205.

The oil pump 205 may include, for example, a cam ring, represented by line 220 provides a lever function. Displacement of the oil pump 205 is directly proportional to a straight line distance between a drive center of the oil pump 205 and a center of the cam ring 220. As the pressures in the primary and secondary chambers 206, 207 act on and cause the cam ring 220 to pivot (the lever function). The center of the cam ring 220 is rotated closer to the drive center of the oil pump 205 when the cam ring 220 is pivoted. In doing so, displacement of the oil pump 205 is reduced, which reduces oil flow output and thus regulates oil pressure. At all times, speed of the oil pump 205 is maintained at crankshaft speed or at a constant proportional value of the crankshaft speed.

Oil from the solenoid valve 216 may be directed to the secondary chamber 207 to adjust pressure on the cam ring 220. This adjusts flow and output pressure of the oil pump 205. As a first example, the solenoid valve 216 may have a first position and a second position. The first position corresponds to the first pressure mode and the second position corresponds with the second pressure mode. In one embodiment, the first position is associated with atmospheric pressure or pressure within the crankcase of the engine 102. The solenoid valve may not be energized when in the first position. The second position is associated with an oil pressure received from the engine 102 or line pressure, such as pressure within the oil line 221. Oil pressure of the oil pump 205 decreases when the solenoid valve is placed in the second position relative to the first position. This decreases oil pressure within the engine 102 and oil pressure supplied to the primary chamber 206. As another example, the solenoid valve 216 may include a fully closed position and a fully open position and may also have any number of positions between the fully closed position and the fully open position.

The solenoid valve 216 may have a vent output 222 to the sump 210. This may be used to adjust oil flow and/or pressure from the solenoid valve 216 to the oil pump assembly 105. The vent output 222 may also be used to limit pressure of oil to the oil pump assembly 105 from the solenoid valve 216.

Operation of the solenoid valve 216 is controlled by the oil pump control module 103 based on engine operating parameters. The engine operating parameters may be determined based on signals from various sensors 230. The sensors 230 may include the engine speed sensor 180, an engine oil temperature (EOT) sensor 232, an engine torque (ET) sensor 234, an engine oil pressure (EOP) sensor 236, and a powertrain relay voltage (PRV) sensor 238. Engine parameters may be indirectly determined via corresponding algorithms instead of directly from sensors. For example, the ECM 104 may indirectly determine engine oil temperature via a corresponding algorithm based on engine operating conditions, states of the engine 102 and ambient conditions instead of directly from an EOT sensor.

The engine torque sensor 234 may be used to directly detect engine output torque. In addition to or as an alternative, the engine output torque may be estimated by an engine torque module 240 (shown in FIG. 3). The powertrain relay voltage sensor 238 may be used to detect voltage of the solenoid valve 216. This voltage may be the voltage of the control signal provided from the oil pump control module 103.

The pressure regulating circuit 204 returns an oil pressure signal via the lubrication circuit 200 back to the oil pump assembly 105 to regulate pressure output of the oil pump 205. The oil pressure signal returned to the oil pump assembly 105 may be received in the primary control chamber 206. Pressure within the primary control chamber adjusts engagement of the lever 220, which in turn affects pressure output of the oil pump 205.

Figure 3:
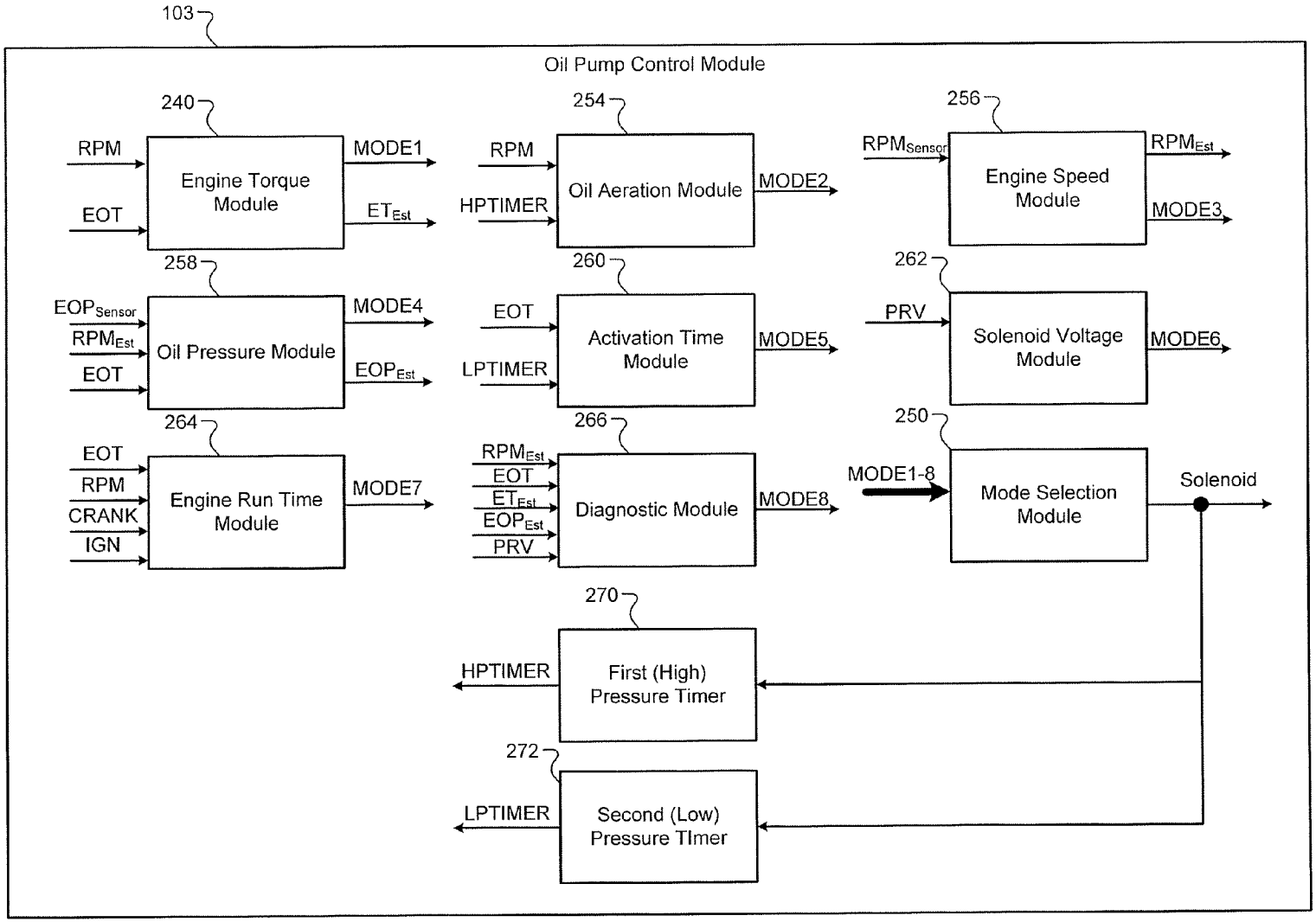
FIG. 3 is a functional block diagram of an oil pump control module in accordance with the present disclosure.
Figure 4:
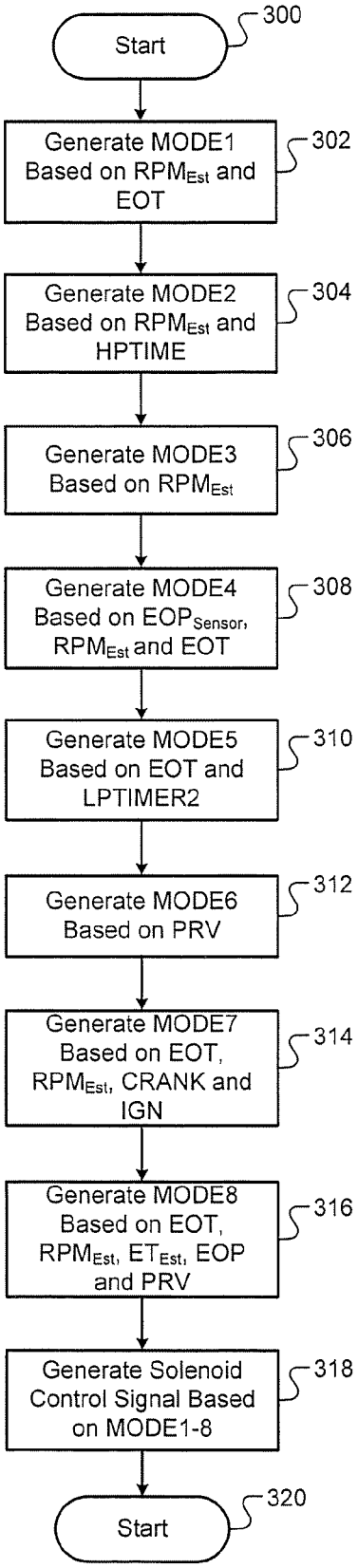
FIG. 4 illustrates a method of operating an oil circulating control system in accordance with the present disclosure.

Referring now also to FIGS. 3 and 4, the oil pump control module 103 and a method of operating the oil circulating control system 101 are shown. The oil pump control module 103 includes a mode selection module 250, an engine torque module 240, an oil aeration module 254, engine speed module 256, an oil pressure module 258, an activation time module 260, a solenoid voltage module 262, an engine run time module 264, and a diagnostic module 266 (collectively referred to as oil pump modules).

The mode selection module 250 generates a solenoid valve control signal based on outputs of the modules 240 and 254-266. In a first example embodiment, the solenoid valve control signal has a first state and a second state. The first state corresponds to the first (high) pressure mode and the second state corresponds to the second (low) pressure mode. In another example embodiment, the solenoid valve control signal is a pulse width modulated signal that is used to control the solenoid valve to position the valve in one of two or more positions.

Although the following tasks are primarily described with respect to the embodiments of FIGS. 1-3, the tasks may be modified for other embodiments of the present disclosure. Also, although the following tasks are described primarily with respect to operating in the first and second pressure modes, the tasks may be modified to operate in addition pressure modes. The method may begin at 300.

At 302, the engine torque module 240 may estimate torque output of the engine 102 and generate an estimated engine torque output signal $ET_{Est}$. The engine torque module 240 generates a first mode request signal MODE1 based on the engine torque output signal $ET_{Est}$, speed of the engine (e.g., speed of the crankshaft) RPM, and/or oil temperature of the engine EOT. Although the modes of FIG. 4 are shown as being performed sequentially, two or more of the modes may be performed during the same period.

As a first example, the first mode request signal MODE1 may be set, for example, HIGH, when the engine torque increases to a torque level that is greater than a predetermined torque for a given engine speed. This indicates that the engine torque module 240 is requesting a transition from the second (low) pressure mode to the first (high) pressure mode. The predetermined torque level may be offset based on the oil temperature of the engine EOT.

As another example, a first value V1 may be determined using equation 1.

$$V1=f\{\mathrm{ET,RPM,EOT}\} \tag{1}$$

The first mode request signal MODE1 may be set HIGH when the first value V1 is greater than a first predetermined level.

As yet another example, a second value V2 may be determined using equation 2, where K is a constant.

$$V2=f\{\mathrm{ET,RPM}\}-K\cdot\mathrm{EOT} \tag{2}$$

The first mode request signal MODE1 may be set HIGH when the second value V2 is greater than a second predetermined level. The mode selection module 250 may set the first mode request signal MODE1 LOW when the engine torque decreases to the predetermined torque and/or when one of the values V1, V2 is less than or equal to the corresponding predetermined level.

At 304, the oil aeration module 254 generates a second mode request signal MODE2 based on the speed of the engine $RPM_{Est}$ and time that the oil pump assembly 105 is operating in the first (high) pressure mode. The oil aeration module 254 may receive a first timer signal TIMER1 from a first (high) pressure timer 270. The first pressure timer 270 monitors time that the oil pump assembly 105 is operating in the first pressure mode. The first pressure timer 270 may generate the first timer signal TIMER1 based on the solenoid valve control signal received from the mode selection module 250.

The oil aeration module 254 may set the second mode request signal MODE2 to, for example, LOW when the first timer signal TIMER1 is greater than a fist predetermined time. This indicates that the oil aeration module 254 is requesting a transition from the first (high) pressure mode to the second (low) pressure mode. This reduces aeration and improves effectiveness of the engine oil. This limits the amount of time that the oil pump assembly 105 is operating in the first (high) pressure mode.

The oil aeration module 254 may set the second mode request signal MODE2 to, for example, HIGH when the speed of the engine 102 is greater than a first predetermined speed and/or when the first timer signal TIMER1 is less than or equal to the first predetermined time.

At 306, the engine speed module 256 determines speed of the engine $RPM_{Est}$ based on the engine speed signal $RPM_{Sen}$-

$_{sor}$ received from the engine speed sensor 180. The engine speed module 256 generates a third mode request signal MODE3 based on the engine speed $RPM_{Est}$. The third mode request signal MODE3 may be set, for example, HIGH when the engine speed is increased to a speed that is greater than a second predetermined speed (e.g., 3000 rpm). This indicates that the engine speed module 256 is requesting a transition from the second (low) pressure mode to the first (high) pressure mode. The third mode request signal MODE3 may be set LOW when the engine speed is decreased to a speed that is less than a third predetermined speed (e.g., 2800 rpm). The second and third predetermined speeds may be equal to or different than the first predetermined speed. This is referred to as providing hysteresis. Hysteresis prevents toggling between pressure modes multiple times with in a predetermined period.

At 308, the oil pressure module 258 determines oil pressure of the engine $EOP_{Est}$ and generates a fourth mode request signal MODE4. The oil pressure may be determined based on an oil pressure signal $EOP_{Sensor}$ from the oil pressure sensor 236. The fourth mode request signal MODE4 may be set, for example, HIGH when the oil pressure is less than a first predetermined oil pressure. The fourth mode request signal MODE4 may be set, for example, LOW when the oil pressure $EOP_{Est}$ is greater than a second predetermined oil pressure. The second predetermined oil pressure is greater than the first predetermined oil pressure to provide hysteresis.

At 310, the activation time module 260 generates a fifth mode request signal MODE5 based on oil temperature of the engine 102 and time that the oil pump assembly 105 is operating in the second (low) pressure mode. The activation time module 260 may receive a second timer signal TIMER2 from a second (low) pressure timer 272. The second pressure timer 272 may generate the second timer signal TIMER2 based on the solenoid valve control signal.

The activation time module 260 may set the fifth mode request signal MODE5, for example, HIGH when the engine oil temperature EOT is greater than a first predetermined temperature and/or when the second timer signal TIMER2 is greater than a second predetermined time. This limits the amount of time that the oil pump assembly 105 is operating in the second (low) pressure mode. The activation time module 260 may set the fifth mode request signal MODE5 LOW when the engine oil temperature EOT is less than a second predetermined temperature and/or when the second timer signal TIMER 2 is less than or equal to the second predetermined time. The second predetermined temperature may be less than the first predetermined temperature to provide hysteresis.

At 312, the solenoid voltage module 262 generates a sixth mode request signal MODE6 based on powertrain solenoid voltage PRV of the solenoid valve. The solenoid voltage module 262 may set the sixth mode request signal MODE6, for example, HIGH when the powertrain solenoid voltage PRV is less than a first predetermined voltage. This indicates a request to transition from the second (low) pressure mode to the first (high) pressure mode. The solenoid voltage module 262 may set the sixth mode request signal MODE6 LOW when the powertrain solenoid voltage PRV is greater than a second predetermined voltage. The second predetermined voltage is greater than the first predetermined voltage to provide hysteresis.

At 314, the engine run time module 264 generates a seventh mode request signal MODE7 based on the engine oil temperature EOT and run time of the engine ERT. The engine run time module 264 may determine the engine run time based on, for example, the speed of the engine $RPM_{Est}$, a crank signal of the engine CRANK, and/or an ignition signal of the engine 102. The run time of the engine 102 indicates the length of time that the engine 102 is operating at a speed greater than a predetermined speed or 0 rpm.

The engine run time module 264 may set the seventh mode request signal MODE7 to, for example, LOW when the engine oil temperature EOT is less than a third predetermined temperature and/or when the engine run time is greater than a third predetermined time (e.g., 10 seconds(s)). This causes the oil pump assembly 105 to initially operate in the first (high) pressure mode upon startup of the engine 102 for at least the predetermine period (engine prime period). This also allows oil pressure to quickly increase and oil to be provided to engine components 212 quickly upon startup. The engine run time module 264 may set the seventh mode request signal MODE7 to, for example, HIGH when the engine oil temperature EOT is greater than or equal to the third predetermined temperature and/or when the engine run time is less than or equal to the third predetermined time.

At 316, the diagnostic module 266 generates a eighth mode request signal MODE8 based on the engine speed $RPM_{Est}$, engine oil temperature EOT, engine oil pressure EOP, torque output $ET_{Est}$, and powertrain solenoid voltage PRV. The diagnostic module 266 generates a diagnostic signal indicating a fault based on the engine speed $RPM_{Est}$, engine oil temperature EOT, engine oil pressure EOP, torque output $ET_{Est}$, and powertrain solenoid voltage PRV. The diagnostic module 266 may set the eighth mode request signal MODE8, for example, HIGH when a fault is indicated. This requests the first (high) pressure mode.

At 318, the mode selection module 250 generates the solenoid valve control signal based on at least one of the first, second, third, fourth, fifth, sixth, seventh, and eighth mode request signals (mode request signals MODE1-8). The mode selection module 250 may generate the solenoid valve control signal based on any combination of the mode request signals MODE1-8.

As a first example, the mode selection module 250 may include an eight input AND gate that receives the eight mode request signals. The output of the AND gate may be HIGH when all of the eight mode request signals MODE1-8 are HIGH. The solenoid valve 216 may be positioned in the first position associated with the high-pressure mode when the output of the mode selection module 250 is HIGH. The solenoid valve 216 may be positioned in the second position associated with the low-pressure mode when the output of the mode selection module 250 is LOW.

As another example, the mode selection module 250 may generate the solenoid valve control signal base on a hierarchy of the modules 240 and 254-266 and/or a hierarchy of the eight mode request signals MODE1-8. A hierarchy refers to a priority ranking of modules and/or signals.

For example, the mode selection module 250 may set the solenoid valve control signal to HIGH when the eighth mode request signal MODE8 is HIGH regardless of the state of one or more of the mode request signals MODE1-7.

As another example, the mode selection module 250 may prevent transitioning from the first (high) pressure mode to the second (low) pressure mode when the second mode request signal is LOW. The mode selection module 250 may prevent transitioning until the third mode request signal MODE 3 is LOW (i.e., the engine speed is less than the first and/or second predetermined speeds). The method may end at 320.

The above-described tasks 300-320 are meant to be illustrative examples; the tasks 300-320 may be performed sequentially or nonsequentially, synchronously or nonsychronously, simultaneously or nonsimultaneously, continuously or noncontinuously, during overlapping time periods or in a different order depending upon the application.

In FIG. 5, an exemplary plot of a pressure mode transition is shown for an oil pump. A first maximum pressure curve 350, a second maximum pressure curve 352, a minimum pressure curve 354 and a pressure transition curve 356 are shown. The first maximum pressure curve 350 illustrates example maximum pressures of the oil pump relative to engine speed when operating in, for example, the second (low) pressure mode. The second pressure curve 352 illustrates example maximum pressures of the oil pump relative to engine speed when operating in, for example, the first (high) pressure mode. The minimum pressure curve 354 illustrates minimum required pressures relative to engine speed for an engine.

The pressure transition curve 356 illustrates the first and second pressure modes and a transition between the first and second pressure modes. The first pressure mode corresponds with curve portion 360. The second pressure mode corresponds with curve portion 362. The transition corresponds with curve portion 364.

In FIG. 6, is an exemplary plot of pressure mode transitions relative to time is shown. An oil pump may initially operate in a high-pressure mode upon engine startup (shown by curve portion 370). The oil pump may transition from a first (high) pressure mode to a second (low) pressure mode after a predetermined period (shown by curve portion 372). The oil pump may transition from the low-pressure mode to the high-pressure mode when the speed of the engine exceeds a predetermined speed (shown by curve portion 374). Although the pressures associated with each mode are shown as constant pressures, the pressures for each mode may vary, for example, based on engine speed.

The above-described embodiments allow for decrease flow and pressures out of an oil pump for improved available engine output torque, reduced parasitic losses and improved fuel economy while satisfying lubrication requirements of an engine.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An oil circulating control system for an engine comprising:

an engine speed module that determines a speed of the engine; a mode selection module that is configured to, based on the speed of the engine, select a first pressure mode and a second pressure mode of an oil pump of the engine, wherein the selection module selects one of the first pressure mode and the second pressure mode based on a mode request signal, wherein the mode selection module signals a solenoid valve of a variable oil pressure circuit of the oil pump to transition to a first position when operating in the first pressure mode and to a second position when operating in the second pressure mode; and an oil aeration module that generates the mode request signal based on the speed of the engine and an amount of time the variable oil pressure circuit is operating in the first pressure mode, wherein the mode selection module signals the solenoid valve based on the mode request signal.

2. The oil circulating control system of claim 1, wherein the speed of the engine is greater than 0 revolutions-per-minute during the first pressure mode and during the second pressure mode.

3. The oil circulating control system of claim 1, wherein oil pressure of the oil pump is greater than 0 kilo-Pascals during the first pressure mode and during the second pressure mode.

4. The oil circulating control system of claim 1, further comprising an engine torque module that generates a second mode request signal based on the speed of the engine and an oil temperature of the engine, wherein the mode selection module signals the solenoid valve based on the second mode request signal generated by the engine torque module.

5. The oil circulating control system of claim 1, wherein:

the engine speed module generates a second mode request signal based on the speed of the engine;

the mode request signal indicates a request for the first pressure mode when the speed of the engine increases to a first speed that is greater than a predetermined threshold;

the mode request signal indicates a request for the second pressure mode when the speed of the engine decreases to a second speed that is less than the first speed; and the mode selection module signals the solenoid valve based on the second mode request signal generated by the engine speed module.

6. The oil circulating control system of claim 1, further comprising an oil pressure module that generates a second mode request signal based on the speed of the engine, an oil pressure of the engine, and an oil temperature of the engine, wherein the mode selection module signals the solenoid valve based on the second mode request signal generated by the oil pressure module.

7. The oil circulating control system of claim 6, wherein:

the second mode request signal from the oil pressure module indicates a request for the first pressure mode when the oil pressure of the engine decreases to a first oil pressure that is less than a predetermined threshold; and the second mode request signal from the oil pressure module indicates a request for the second pressure mode when the oil pressure of the engine increases to a second oil pressure that is greater than the first oil pressure.

8. The oil circulating control system of claim 1, further comprising an activation time module that generates a second mode request signal based an oil temperature of the engine and an amount of time that the variable oil pressure circuit is operating in the second pressure mode, wherein the mode selection module signals the solenoid valve based on the second mode request signal generated by the activation time module.

9. The oil circulating control system of claim 1, further comprising a solenoid voltage module that generates a second mode request signal based on voltage of the solenoid valve, wherein the mode selection module signals the solenoid valve based on the second mode request signal generated by the solenoid voltage module.

10. The oil circulating control system of claim 1, further comprising an engine run time module that generates a second mode request signal based on an engine run time and an oil temperature of the engine, wherein the mode selection module signals the solenoid valve based on the second mode request signal generated by the engine run time module.

11. The oil circulating control system of claim 1, further comprising a diagnostic module that generates a second mode request signal based on a diagnostic fault, wherein the mode selection module signals the solenoid valve based on the second mode request signal generated by the diagnostic module.

12. The oil circulating control system of claim 11, wherein the diagnostic module generates a diagnostic fault based on at least one of the speed of the engine, an oil temperature of the engine, torque of the engine, an oil pressure of the engine, and a voltage of the solenoid valve.

13. The oil circulating control system of claim 11, wherein the diagnostic module generates a diagnostic fault based on the speed of the engine, an oil temperature of the engine, torque of the engine, an oil pressure of the engine, and a voltage of the solenoid valve.

14. The oil circulating control system of claim 1, further comprising:

an engine torque module that generates a first mode request signal based on the speed of the engine and an oil temperature of the engine; and an oil pressure module that generates a second mode request signal based on the speed of the engine, an oil pressure of the engine, and the oil temperature, wherein the mode selection module signals the solenoid valve based on the first mode request signal and the second mode request signal from the engine torque module.

15. The oil circulating control system of claim 1, further comprising an activation time module that generates a second mode request signal based an oil temperature of the engine and an amount of time that the variable oil pressure circuit is operating in the second pressure mode, wherein:

the oil aeration module generates a first mode request signal based on the speed of the engine and the amount of time that the variable oil pressure circuit is operating in the first pressure mode; and the mode selection module signals the solenoid valve based on the first mode request signal and the second mode request signal.

16. The oil circulating control system of claim 1, wherein:

the solenoid valve defaults to the first position when deactivated; and the first pressure mode has a corresponding oil pressure that is greater than an oil pressure corresponding to the second pressure mode.

17. The oil circulating control system of claim 1, further comprising:

the variable oil pressure circuit comprising the oil pump; and the solenoid valve, wherein the oil pump is connected to a crankshaft of the engine.

18. A method of operating an oil circulating control system of an engine, the method comprising:

determining a speed of the engine;

receiving a first mode request signal;

based on the speed of the engine, selecting a first pressure mode of an oil pump of the engine when the first mode request signal is in a first state;

based on the speed of the engine, selecting a second pressure mode of the oil pump when the mode request signal is in a second state;

signaling a solenoid valve of a variable oil pressure circuit of the oil pump to transition to a first position when operating in the first pressure mode and to a second position when operating in the second pressure mode;

generating a second mode request signal based on the speed of the engine, an oil pressure of the engine, and an oil temperature of the engine; and signaling the solenoid valve based on the second mode request signal, wherein the second mode request signal indicates a request for the first pressure mode when the oil pressure of the engine decreases to a first oil pressure that is less than a predetermined threshold, and the second mode request signal indicates a request for the second pressure mode when the oil pressure of the engine increases to a second oil pressure that is greater than the first oil pressure.

19. The method of claim 18, further comprising:

generating a third mode request signal based on the speed of the engine and an oil temperature of the engine;

generating a fourth mode request signal based on the speed of the engine, an oil pressure of the engine, and the oil temperature; and signaling the solenoid valve based on the third mode request signal and the fourth mode request signal.

20. An oil circulating control system for an engine comprising:

an engine speed module that determines a speed of the engine;

a mode selection module that is configured to, based on the speed of the engine, select a first pressure mode and a second pressure mode of an oil pump of the engine, wherein the selection module selects one of the first pressure mode and the second pressure mode based on at least one mode request signal, wherein the mode selection module signals a solenoid valve of a variable oil pressure circuit of the oil pump to transition to a first position when operating in the first pressure mode and to a second position when operating in the second pressure mode; and at least one of an activation time module that generates a first mode request signal based an oil temperature of the engine and an amount of time that the variable oil pressure circuit is operating in the second pressure mode, a solenoid voltage module that generates a second mode request signal based on voltage of the solenoid valve, an engine run time module that generates a third mode request signal based on an engine run time and an oil temperature of the engine, and a diagnostic module that generates a fourth mode request signal based on a diagnostic fault, wherein the at least one mode request signal includes at least one of the first mode request signal, the second mode request signal, the third mode request signal, and the fourth mode request signal.

* * * * *